US006025808A

United States Patent [19]

Mileski

[11] Patent Number: 6,025,808

[45] Date of Patent: Feb. 15, 2000

[54] PASSIVE SURFACE DEPLOYED VARIABLE INDUCTANCE WIRE ANTENNA

[75] Inventor: Paul M. Mileski, Mystic, Conn.

[73] Assignee: The United States of America as represented by the Secretary of the Navy, Washington, D.C.

[21] Appl. No.: 08/130,941

[22] Filed: Oct. 4, 1993

[51] Int. Cl.[7] ..... H01Q 9/00

[52] U.S. Cl. ..... 343/749; 343/719; 343/828; 343/830

[58] Field of Search ..... 343/707, 709, 343/723, 749, 826, 830, 828, 851, 877, 745, 750, 719; H01Q 9/00

[56] References Cited

U.S. PATENT DOCUMENTS

| | | | |
|---|---|---|---|
| 1,424,365 | 8/1922 | Loftin et al. | 343/723 |
| 2,177,415 | 10/1939 | Alford | 343/749 |
| 2,982,964 | 5/1961 | Bresk et al. | 343/750 X |
| 3,273,153 | 9/1966 | Icenbice, Jr. | 343/707 |
| 4,067,235 | 1/1978 | Markland et al. | 73/146.5 |
| 4,117,495 | 9/1978 | Hochstein | 343/745 X |
| 4,743,917 | 5/1988 | Huntsman et al. | 343/877 |
| 4,750,001 | 6/1988 | Grose et al. | 343/877 |
| 4,962,383 | 10/1990 | Tresselt | 343/700 MS |
| 5,065,163 | 11/1991 | Mears | 343/877 X |
| 5,089,827 | 2/1992 | Pizon | 343/749 X |
| 5,223,848 | 6/1993 | Rammos et al. | 343/853 X |

FOREIGN PATENT DOCUMENTS

| | | | |
|---|---|---|---|
| 0238107 | 10/1986 | Japan | 343/749 |
| 0251209 | 11/1986 | Japan | 343/749 |

*Primary Examiner*—Michael C. Wimer
*Attorney, Agent, or Firm*—Michael J. McGowan; Prithvi C. Lall; Michael F. Oglo

[57] ABSTRACT

An antenna adapted for surface deployment is provided. A coaxial feedline, terminated at one end thereof at a feedpoint, has a center conductor and a shield at ground potential. A continuous length of antenna wire having first and second ends is electrically connected at its first end to the center conductor at the feedpoint. A first portion of the continuous length is spooled adjacent the first end. A second portion of the continuous length is deployed from the first portion by means of tension at the second end. The second portion extends to the second end along a substantially straight line away from the first portion. The second portion is typically at least as long as the first portion. The first portion serves as a variable tuning inductor for the antenna as the second portion is deployed therefrom.

17 Claims, 2 Drawing Sheets

PASSIVE SURFACE DEPLOYED VARIABLE INDUCTANCE WIRE ANTENNA

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to wire antennas, and more particularly to a wire antenna designed for surface deployment and having a variable inductance capability.

(2) Description of the Prior Art

In remote and/or harsh environments (e.g., polar regions, deserts, etc.) communications antennas are ideally installed in such a fashion that their structural integrity will be maintained for a long period of time. In addition, the antenna in its installed configuration must provide communication over a bandwidth of interest. Finally, the installation environment may affect the antenna's response characteristics such that the antenna must be tuned once it is installed. Naturally, it is desirable to satisfy all of these criteria with a simple, low cost design using only passive (i.e., no power required) components.

SUMMARY OF THE INVENTION

Accordingly, it is an object of the present invention to provide an antenna design suitable for deployment in remote and/or harsh environments.

Another object of the present invention is to provide an antenna design that is easily tuned once it is installed.

Still another object of the present invention is to provide an antenna design that is simply designed with passive components thereby making it ideal for long term deployment.

Other objects and advantages of the present invention will become more obvious hereinafter in the specification and drawings.

In accordance with the present invention, an antenna adapted for surface deployment is provided. A coaxial feedline, terminated at one end thereof at a feedpoint, has a center conductor and a shield at ground potential. A continuous length of antenna wire having first and second ends is electrically connected at its first end to the center conductor at the feedpoint. A first portion of the continuous length is spooled adjacent the first end. A second portion of the continuous length is deployed from the first portion by means of tension at the second end. The second portion extends to the second end along a substantially straight line away from the first portion. The second portion is typically at least as long as the first portion.

BRIEF DESCRIPTION OF THE DRAWING(S)

Other objects, features and advantages of the present invention will become apparent upon reference to the following description of the preferred embodiments and to the drawings, wherein.

DESCRIPTION OF THE PREFERRED EMBODIMENT(S)

Figure 1:
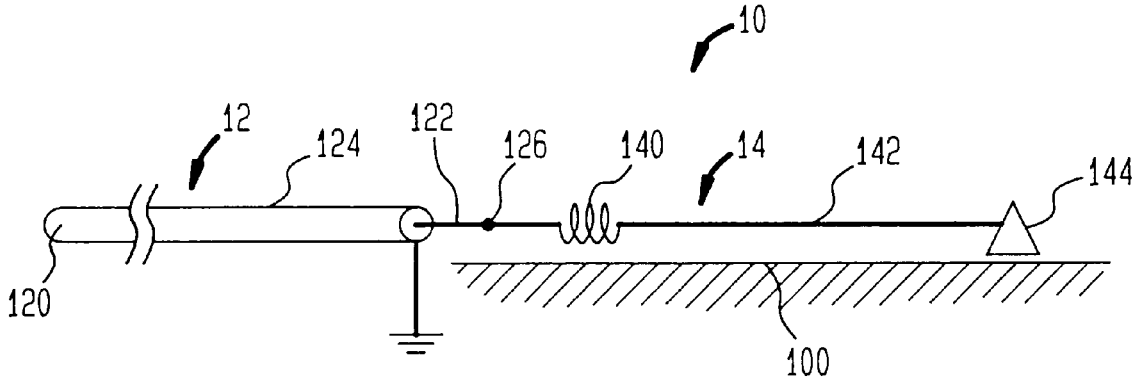
FIG. 1 is a schematic representation of an antenna designed for surface deployment in accordance with the present invention.

Referring now to the drawings, and more particularly to FIG. 1, a schematic drawing is shown of an antenna 10 in its simplest embodiment adapted for deployment on a surface 100 according to the present invention. Antenna 10 includes a coaxial cable 12 connected on one end 120 to a radio source or receiver (not shown). Coaxial cable 12 is any conventional coaxial cable having a center conductor 122 and shield 124 encasing center conductor 122. Coaxial cable 12 terminates at a point 126 where shield 124 is connected to a ground potential and center conductor 122 is electrically connected to an antenna leg 14.

Antenna leg 14 is a continuous length of antenna wire that is firstly spooled adjacent to point 126 as indicated by coiled portion 140, and secondly paid out from coiled portion 140 to extend therefrom in a substantially straightline fashion as indicated by straight portion 142. To maintain the position and orientation of straight portion 142 on surface 100, an electrically non-conductive weight 144 can be used to terminate straight portion 142. Alternatively, weight 144 can be replaced with an anchoring apparatus (not shown) embedded in surface 100.

Antenna wire 14 is a conductive fiber and is preferably stranded Litz wire encased in fabric. For low frequency antenna (less than 2 MHz), the use of Litz wire decreases loss. Furthermore, Litz wire is flexible and therefore is well suited to being formed into coiled portion 140 as well as being easily deployed from coiled portion 140.

Figure 2:
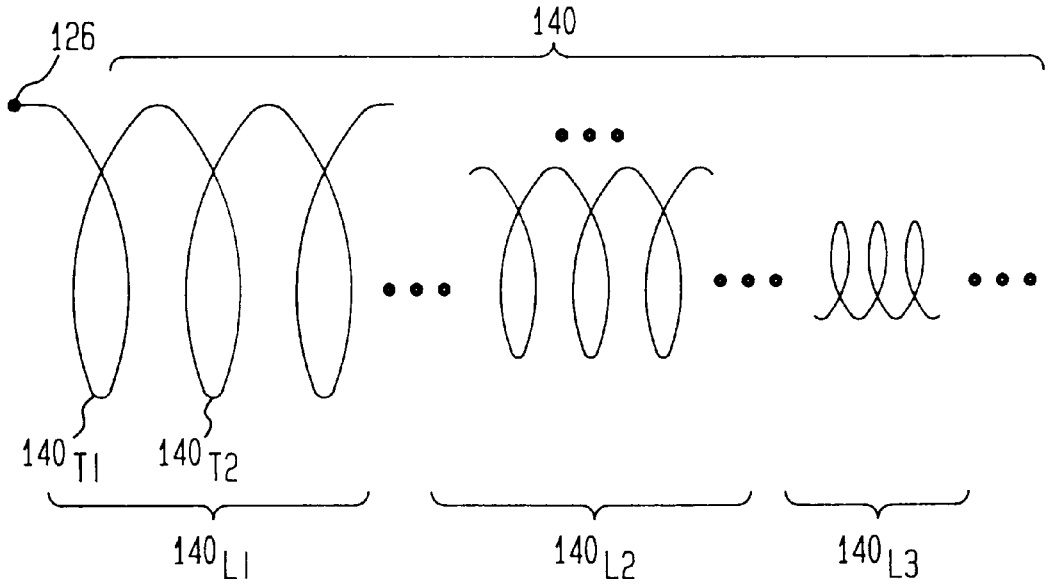
FIG. 2 is a schematic representation of the coiled portion of the antenna.

Coiled portion 140, shown in greater detail in FIG. 2, may be a self-contained spool consisting of adjacent turns of $\mathbf{140}_{T1}$, $\mathbf{140}_{T2}$ . . . of antenna wire 14 formed in one or multiple concentric layers $\mathbf{140}_{L1}$, $\mathbf{140}_{L2}$ . . . . A thin plastic membrane (not shown) such as shrink wrap can also be used to restrain coiled portion 140. Preferably, coiled portion 140 is formed as a cylinder such that adjacent turns in a respective layer have a substantially equal radius. Alternatively, coiled portion 140 can be formed into other suitable shapes (e.g., cone). In either case, straight portion 142 is paid out from the innermost layer of the concentric layers forming coiled portion 140.

In order to understand operation of the present invention, it is first necessary to review how inductance L is determined for a coil. In general, for a coil having a single layer of n turns $$L = n^2\left(\frac{r^2}{9r + 10l}\right)$$

where r is the radius of the coil, and 1 is the length of the coil.

If n is large and turns are removed from a coil in such a way that the change in both radius and number of turns is minimal, the change in inductance is nearly linear. Thus, in terms of the present invention, the inductance of coiled portion 140 may be changed in an approximate linear fashion as straight portion 142 is paid out from coiled portion 140. In this way, as straight portion 142 is pulled from coiled portion 140, coiled portion 140 becomes a tuning inductor for antenna leg 14.

If a multi-layered coil is used as shown in FIG. 2, the calculation of inductance L is more complex. However, since coiled portion 140 is wound so that the pay out occurs from the innermost layer of adjacent turns where r is smallest, the change in inductance still occurs in an essentially linear fashion with pay out of straight portion 142. As with the single layer coil, this change can be used to offset the change in length of straight portion 142 (i.e., the radiating wire). The result is that the length of straight portion 142 is not as critical as it would be if the inductance of coiled portion 140 were a fixed value.

For the best radiation efficiency in many communication applications, it has been found that the length of straight portion 142 should preferably be equal to or greater than the length of antenna 14 that remains undeployed in coiled portion 140. However, it is to be understood that the relative lengths of coiled portion 140 and straight portion 142 depend on the particular application's efficiency requirements and/or tolerance of reduced efficiency.

Figure 3:
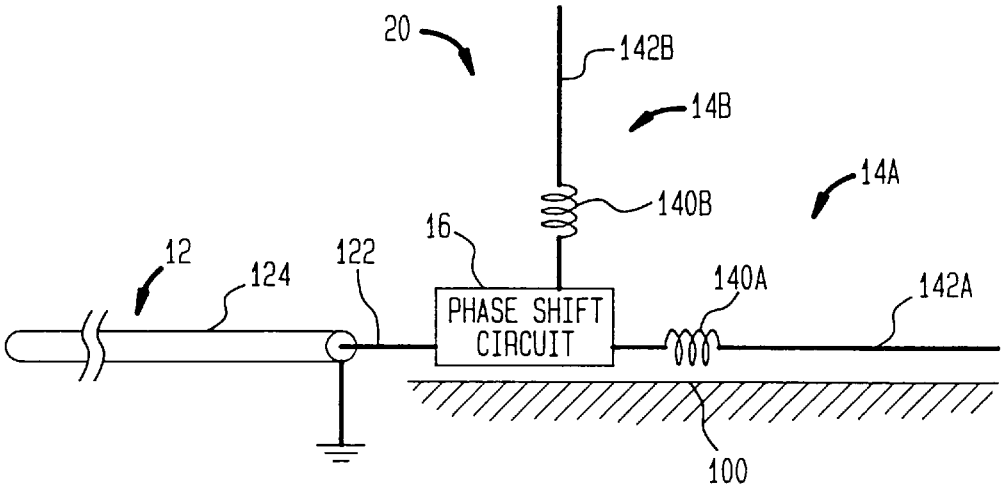
FIG. 3 is a schematic representation of a two-leg omnidirectional antenna built in accordance with the present invention.

While the present invention has been described relative to a single antenna leg 14, it is not so limited. As shown in FIG. 3, an omnidirectional antenna 20 may be constructed in accordance with the present invention by providing antenna legs 14A and 14B spaced apart from one another by an angle of approximately 90'. Each of antenna legs 14A and 14B lies on a horizontal surface 100 and includes corresponding coiled portions 140A and 140B and straight portions 142A and 142B. Each of antenna legs 14A and 14B is connected to a 90' phase shifting circuit 16 so that the resulting antenna 20 displays an omnidirectional radiation pattern. The output of phase shifting circuit 16 is connected to center conductor 122 of coaxial cable 12. As in the single antenna leg embodiment, shield 124 is connected to ground potential. Additional antenna legs configured according to the present invention may be used depending on the application.

Figure 4:
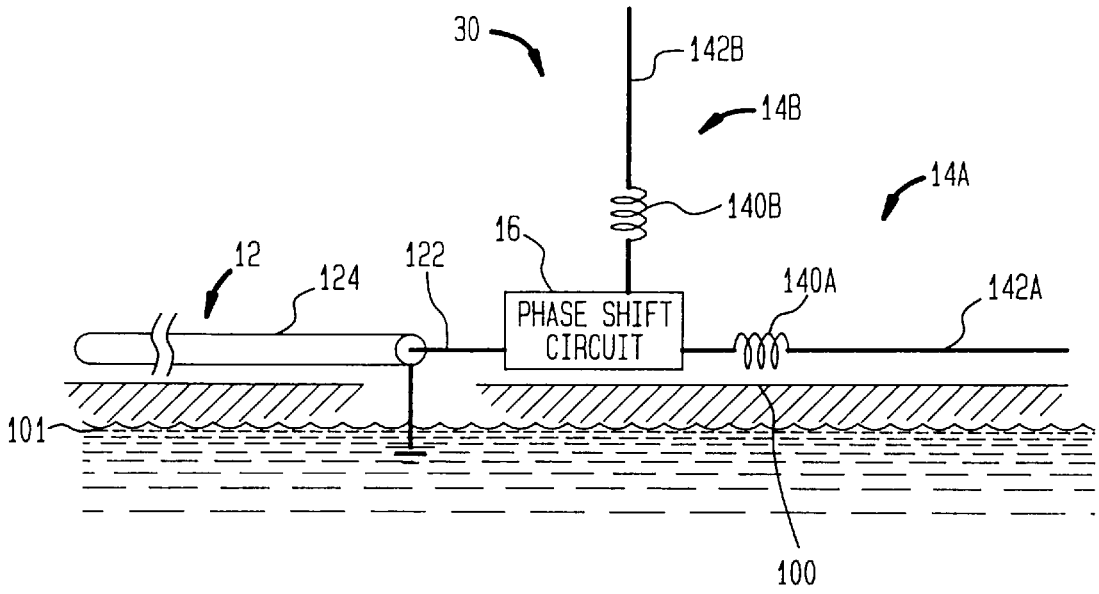
FIG. 4 is a schematic representation of a two-leg omnidirectional 715 KHz antenna deployed on sea ice.

By way of example, a 715 KHz omnidirectional antenna 30, configured according to the present invention, is shown in FIG. 4. Surface 100 is sea ice and shield 124 of coaxial cable 12 is fed to sea water 101 for use as the ground potential. Each of antenna legs 14A and 14B consisted of size 10/44 nylon covered, preferably enamel insulated Litz wire manufactured by New England Wire Corporation. Each of antenna legs 14A and 14.B was configured such that respective coiled portions 140A and 140B were tuned to appear as 90 $\mu$H inductors. To achieve this inductance value, each of coiled portions 140A and 140B was a single layer coil with n equal to 80 turns, r equal to approximately 0.45", and 1 equal to approximately 2.1". Each of straight portions 142A and 142B was paid out from coiled portions 140A and 140B to approximately 100 feet. Exact lengths of straight portions 142A and 142B can be adjusted on site as antenna 30 is deployed/tuned. It should be noted that if such an antenna were to be constructed without the inductance of coiled portions 140A and 140B, each antenna leg would require approximately 330 feet of length. However, in many environments, it is not be feasible to deploy such a large amount of antenna wire.

Deployment of the straight portion from the coiled portion of an antenna leg may be manually achieved. However, owing to the coil pack design, deployment of the straight portion is well suited for a launcher or gun activation. In such a case, a projectile would be used to terminate the straight portion of an antenna leg. The projectile could be launched to carry the straight portion a given distance in an aimed direction. This automated form of deployment may be required in harsh and/or remote environments.

The advantages of the present invention are numerous. A simple, passive component antenna design is presented for use in surface deployed applications. Since the antenna leg is a continuous wire that includes an adjustable turn/radius coiled portion (tuning inductor) and a straight portion (radiator), the antenna is easily tuned to resonance at time of installation.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An antenna for deployment on a surface, comprising:

a coaxial feedline having a center conductor and a shield at ground potential, said coaxial feedline terminating at one end thereof at a feedpoint;

a continuous length of antenna wire having first and second ends, said continuous length being electrically connected at said first end to said center conductor at said feedpoint;

a first portion of said continuous length serving as a variable tuning inductor, said first portion formed from concentric cylindrical coils of said antenna wire adjacent said first end, each of said concentric cylindrical coils defined by a plurality of adjacent turns of said antenna wire; and a second portion of said continuous length serving as an antenna radiator, said second portion extending from an innermost one of said concentric cylindrical coils to said second end along a substantially straight line on the surface.

2. The antenna as in claim 1 wherein a lineal length of said second portion is at least as long as a lineal length of said first portion.

3. The antenna as in claim 1 wherein said antenna wire is Litz wire.

4. The antenna as in claim 3 wherein said Litz wire is encased in fabric.

5. The antenna as in claim 1 wherein the surface of deployment is the surface of sea ice and wherein said shield has ground potential provided by seawater.

6. The antenna as in claim 1 further comprising a weight for maintaining said second portion along said substantially straight line on the surface.

7. The antenna as in claim 6 wherein said weight is attached to said second end.

8. The antenna as in claim 7 wherein said weight is electrically non-conductive.

9. An antenna for deployment on a surface comprising:

a coaxial feedline having a center conductor and a shield at ground potential, said coaxial feedline terminating at one end thereof at a feedpoint;

a phase shifter electrically connected at its output to said center conductor at said feedpoint; and a plurality of antenna legs, each of said plurality of antenna legs being spaced apart from one another on the surface, each of said plurality of antenna legs including (1) a continuous length of antenna wire having first and second ends, said continuous length being electrically connected at said first end to an input of said phase shifter, (2) a first portion of said continuous length serving as a variable tuning inductor, said first portion formed from concentric cylindrical coils of said antenna wire adjacent said first end, each of said concentric cylindrical coils defined by a plurality of adjacent turns of said antenna wire, and (3) a second portion of said continuous length serving as an antenna radiator, said second portion extending from an innermost one of said concentric cylindrical coils to said second end along a substantially straight line on the surface.

10. The antenna as in claim 9 wherein a lineal length of said second portion is at least as long as a lineal length of said first portion.

11. The antenna leg as in claim 9 wherein said antenna wire is Litz wire.

12. The antenna leg as in claim 11 wherein said Litz wire is encased in fabric.

13. The antenna as in claim 9 wherein the surface of deployment is the surface of sea ice and wherein said shield has ground potential provided by seawater.

14. The antenna as in claim 9 further comprising a weight for maintaining said second portion along said substantially straight line on the surface.

15. The antenna as in claim 14 wherein said weight is attached to said second end.

16. The antenna as in claim 15 wherein said weight is electrically non-conductive.

17. The antenna as in claim 9 wherein said plurality of antenna legs comprise two antenna legs spaced apart from one another by an angle of approximately 90°, and wherein said phase shifter is a 90° phase shifting circuit.

* * * * *